United States Patent [19]

Billette de Villemeur et al.

[11] Patent Number: 4,627,679

[45] Date of Patent: Dec. 9, 1986

[54] CONTINUOUS-ACCESSIBILITY ELECTRICAL CONDUITS

[75] Inventors: Philippe M. Billette de Villemeur, Paris; Gerard L. Pournain, Mortain; Louis A. Cahu, Ducey, all of France

[73] Assignee: Establissements A. Gregoire & Barilleau, Maisons Alfort, France

[21] Appl. No.: 673,710

[22] Filed: Nov. 21, 1984

[30] Foreign Application Priority Data

Nov. 21, 1983 [FR] France ..... 83 18492

[51] Int. Cl.[4] ..... H01R 25/14

[52] U.S. Cl. ..... 339/21 R; 174/95; 174/101

[58] Field of Search ..... 174/95, 97, 101; 52/287; 339/20, 21 R, 22 R, 23, 61 C

[56] References Cited

U.S. PATENT DOCUMENTS 3,777,300 12/1973 de Villemeur ..... 339/21 R

FOREIGN PATENT DOCUMENTS 2082553 12/1971 France ..... 339/21 R

*Primary Examiner*—Laramie E. Askin

*Attorney, Agent, or Firm*—Sughrue, Mion, Zinn, Macpeak, and Seas

[57] ABSTRACT

The present invention concerns a continuous-accessibility electrical conduit comprising: at least one U-shaped case (4) having at least one longitudinal interior partition (10) forming boxes (11); a cover (5) set up to carry conductors and provided with slots (20) that permit access to the conductors, and/or a blind cover (28) forming an empty channel; and snap-lock means (12, 13, 24; 14; 39) provided on the free edges of the lateral walls and the partition of the base, as well as on opposite areas of the covers.

18 Claims, 6 Drawing Figures

CONTINUOUS-ACCESSIBILITY ELECTRICAL CONDUITS

The present invention concerns improvements to continuous-accessibility electrical conduits designed to have the appearance when mounted to a plinth or molding, with a front surface made of nonconducting material and equipped with at least two narrow, parallel, longitudinal access slots and at least two electrical conductors that stretch parallel to each other behind said slots.

Numerous types of conduits of the aforementioned type are already known, for example, those described in French Pat. No. 2,082 and U.S. Pat. No. 3,777,300.

Even though these known conduits have been considered acceptable as far as electrical reliability and safety are concerned, none was designed mechanically with a view to present-day use. In particular, none has satisfactory mechanical resistance or can, without weakening, withstand the transversal forces generated by the removal of a removable plug. Furthermore, these known conduits lend themselves badly to variations in the number of conductors required, so that, in practice, it was necessary to provide as many different types of conduit as there were electrical outlet systems (system with two live leads, system with two leads and ground, three leads, neutral, and ground, etc.).

These various drawbacks acted as a brake on the development of this type of electric conduit.

The essential purpose of the invention is to remove the abovementioned drawbacks and to design an electrical conduit of the type cited above that will satisfy various practical requirements better than the known conduits, and, in particular, one that will withstand without difficulty transversal pulling forces exerted on the cover, that will lend itself to multiple combinations so as to allow for all electric power supply diagrams, that will be structured so as to have an acceptable appearance, that can be manufactured from plastics by traditional extrusion techniques, and that generally will be simple in structure, low in cost, and easy to install.

For these purposes, an electrical conduit under the invention is characterized in that it comprises:

a base in the form of a case with a more or less U-shaped cross-section open toward the front and intended to be fastened onto a backing (e.g., a wall), with said case comprising at least one longitudinal inner partition delimiting individual boxes to house each conductor in the operating position of the conduit;

a cover to close the case, said cover having the general shape of a plate provided with said conductor-access slots and supporting, on its back surface, said conductors;

and snap-lock means provided on the longitudinal free edges of the lateral walls of the case and on the longitudinal edges of the inner partition(s), as well as on the longitudinal areas of the cover located opposite said longitudinal edges of the walls and partition(s) of the case when the cover is mounted on the case;

and further characterized in that adjoining snap-lock means n and n+1 are separated by a distance E defined as follows, with the conductors being separated by a constant interval p:

$$E(n, n+1)=p+ke \text{ for even n}$$

$$E(n, n+1)=p-ke \text{ for odd n (other than 1)}$$

and $$E(1, 2)=p-k_o e \text{ for n=1}$$

with p=constant interval between conductors e=thickness of cover k=constant $k_o$=constant greater than k n=order number of conductor counting from the edge of the cover having the first rib (rib 1).

By virtue of these arrangements, when the cover is mounted on the case, or, otherwise stated, in the operating position of the conduit, each conductor is enclosed in a box and electrically insulated from the adjoining conductor(s), while each box is mechanically closed over the entire length of its two longitudinal edges.

The forces connected with transversally extracting a removable connector from the conduit are distributed among the snap-lock means so that the individual transversal forces exerted on each of said means are greatly reduced. The cover can no longer become deformed (bowed) in any notable way and there is no longer any risk of the cover becoming detached, as was common with the earlier devices.

Advantageously, the constants k and $k_o$ will be equal to ⅓ and 5/3 respectively. In this way, the cover cannot be suitably put into place and locked onto the case except in one of the two positions in which it can be placed in front of the case.

Preferentially, the snap-lock means consist of protruding ribs with a beak-shaped cross-section that form shoulders extending respectively along the free edges of the lateral walls and partitions of the case and along the wings that face the cover. The snap-lock means are further characterized in that on case and cover all of the ribs face in the same direction, with the exception of one facing in the opposite direction. The case and the cover may thus be formed of plastic material and extruded through dies of appropriate shapes.

It is interesting that the rib turned in the opposite direction from the others is borne by one of the lateral walls of the case and by a wing located along an edge of the cover. This arrangement constitutes an additional security means which, in combination with the variable spacing of the snap-lock means, will prevent unauthorized connections of elements.

The conduits of the invention may further be set up to form a complete system capable of being adapted to various practical requirements.

Thus the cover may be essentially equal in width to the outer width of the case and several cases with their covers may be juxtaposed.

The width of the cover may also be less than the outer width of the case by a value essentially equal to half the thickness of a lateral wall of the case, shoulders may be provided on both sides of the interior partitions, and at least two covers may be snapped side-by-side onto the same case.

A blind cover without a conductor might also be provided to cover at least one box and form at least one empty channel.

Cases of various sizes may be assembled side by side to obtain the number of boxes required, and these may be covered with various covers, with or without conductors, to form electrical transmission lines or ducts for later installation of related wiring, according to use requirements.

Advantageously, in cases where each conductor is offset from the corresponding access slot, it is provided that a plane joining the median axis of a slot and the median axis of the corresponding conductor form an angle of at least 20° with the regular plane of the cover.

In addition, when each conductor is positioned and held in place in a duct formed of a piece with the cover and opening onto the corresponding access slot, it is provided that the median axis of the duct is inclined away from the normal plane of the cover by at least 20° and that the outer contour of this duct and the inner contour of the corresponding box are arranged such that the duct can enter the corresponding box of the case, and thereby enable the cover to be installed onto the case, in only one of the two possible positions in which the cover can be held up to the case. Such an arrangement combines with those previously set forth to prevent incorrect connections of the components.

This security function may be still further improved by taking advantage of the fact that all of the lateral walls and interior partitions of the case that have snap-lock ribs turned in one direction are backed up, on the side of the rib, by a reinforcement wing that lies opposite and apart from the snap-lock rib. In the offset-conductor configuration, this reinforcement wing also constitutes a safety stop that prevents a duct from entering the coresponding box when the cover is not presented opposite the case in the predetermined position.

Advantageously, each case unit comprises a longitudinal tab located outside along the extension of the base of the case for purposes of identifying a direction of installation of the case, with the tab being manually removable in order to allow side-by-side juxtaposition of more than one case. For example, the height of this tab is between H/3 and H, with H being the depth of the conduit.

Again in the interest of avoiding involuntary contact between live elements, in cases where the number of conductors is three or more the distances separating consecutive access slots alternatively have two set values $D_1$ and $D_2$, and $D_1$ not equal to $D_2$, and such that $D_1+D_2=2p$, with p being the interval between the conductors.

To avoid the incorrect placement of a removable connector or plug (particularly in cases where there are two conductors) and to avoid contact between nonconnectable elements, it is provided that the cover comprise a longitudinal deformation (either male or female) located closer to one of the longitudinal edges of the cover than to the other and designed to fit together with a deformation of complementary shape (female or male) on a removable connector or plug designed to fit into with the conduit.

It is also possible to provide a safety cover set up like a blind cover, sized to cover at least one box of a case and having at least two longitudinal, parallel ridges that protrude on the two surfaces of said cover. Advantageously, this safety cover is wider than a corresponding ordinary cover (blind or equipped with conductors) and shaped in such a way that the part having a ridge on the outside partially covers, when mounted, the cover of the adjoining box. Preferentially, to increase the number of safety devices, the safety cover is provided with snap-lock means enabling it to be positioned on the case in both of the two possible directions of mounting.

The invention will be better understood upon reading the following detailed description of certain embodiments that are provided solely by way of illustrative example and without any limitation whatsoever. This description makes reference to the attached drawings, in which.

Figure 1:
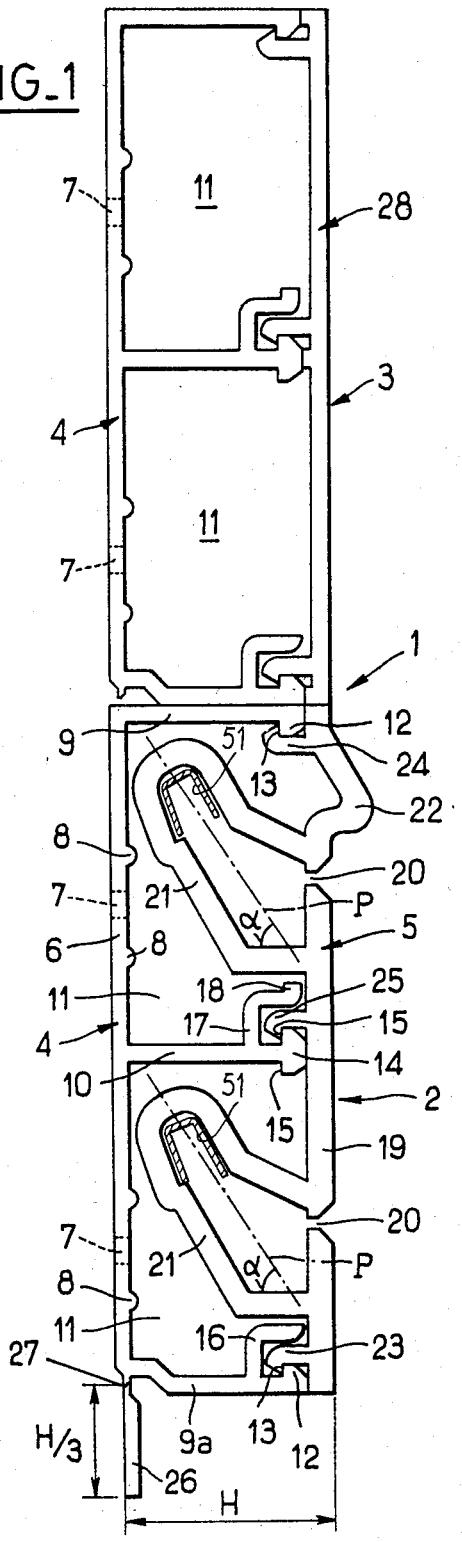
FIG. 1 is a schematic, large-scale, end view of a section of conduit conforming to the invention.

Reference is made first to FIG. 1, which shows a conduit 1 consisting of two elementary conduits 2 and 3.

Conduit 2 consists of a case 4 and cover 5 that locks onto the case to close it.

Case 4 comprises a base 6 provided with holes 7 for fastening it (with nails, screws, etc.) to a flat backing (e.g., a wall) as a plinth or molding. Longitudinal stiffening ribs 8 may be provided on the inner surface of base 6. Two lateral walls 9 and **9*a* extend essentially perpendicularly from the base, so that case 4** has an approximately U-shaped cross-section.

Case 4 further comprises an inner partition 10, parallel to lateral walls 9 and **9*a*, that divides the interior space of the case into two boxes 11**.

The free longitudinal edges of lateral walls 9 and **9*a* are provided with longitudinal ribs 12 that protrude into the box and, in cross-section, have the general shape of a beak and are designed to form a longitudinal shoulder 13** that is turned toward the base of the case.

The free longitudinal edge of inner partition 10 is equipped in the same manner, with the exception that rib 14 protrudes from both sides of the partition to define two shoulders 15.

In addition, lateral wall **9*a*, which is located in the lower position when the conduit is mounted on a wall (the position shown in FIG. 1), is provided with a longitudinal grip reinforcing wing 16 having a generally L-shaped cross-section and lying opposite rib 12** at a distance from the latter that is less than the thickness of the complementary snap-lock piece (treated below) in order to reinforce the gripping of said piece.

In the same way, partition 10 is also equipped with a longitudinal grip reinforcing wing 17 that protrudes into upper box 11 (still on FIG. 1) and extends opposite rib 14 at some distance from it. The cross-section of wing 17 is also generally L-shaped, with the free leg of the L ending in a longitudinal flange 18 that is parallel to the case of the case.

Cover 5 has a main surface 19 that is generally flat and has the same dimensions and shape as the outer periphery of case 4, so that the edges of the cover are aligned with the lateral walls of the case as shown in FIG. 1.

Main surface 19 is provided with two longitudinal slots 20 opening approximately into the middle of boxes 11 when cover 5 is mounted onto case 4 as shown in FIG. 1. Said slots 20 are designed to admit the male electrical connectors of a removable connector or plug that is not shown.

On the back side of main surface 19 of cover 5 are found two protruding curvilinear surfaces that form, together with a portion of main surface 19, two ducts or channels 21 that are open to the outside through slots 20. The bottom of these ducts is shaped, in a way that is in itself known, so as to receive and grip two metal electrical conductors 51.

Channels 21 are relatively deep with respect to the size of the conductors they enclose. They are also inclined upwards (in FIG. 1) with respect to the main surface 19 of cover 5 so that their median plane (P) forms an angle alpha of at least 20°, and usually about 45°, with the plane that is orthogonal to main surface 19. This arrangement is intended to ensure safety in a way that is in itself known and to ensure that an electrical conductor that might be inserted through one of the slots 20 will not come into contact with the corresponding conductor rail.

The general shape of ducts 21 is such that when cover 5 is mounted on case 4 as shown in FIG. 1, the ducts are lodged within the two boxes 11 in the case without touching their walls.

It will also be noted that, in the example shown in FIG. 1, slots 20 are both located in the immediate proximity of the upper intersections of ducts 21 with the main surface 19 of cover 5.

Main surface 19 of cover 5 may further have a longitudinal ridge 22 protruding from the outer surface of surface 19. This ridge is designed to fit into a hollow of corresponding shape provided in the aforementioned removable connector or plug (not shown) to prevent errors when the connector is plugged into the duct.

Lastly, cover 5 has snap-lock means protruding from its inner surface and designed to snap together with locking ribs 12 and 14 of case 4. These snap-lock means take the shape of protruding wings with a free end bent back to form (in cross-section) a beak-shaped gripper with a shoulder designed to snap together with aforementioned shoulders 13 and 15 of the case. The two end wings, lower 23 and upper 24, are recessed slightly from the two corresponding longitudinal edges of surface 19 and are curved toward the free edges of that surface. In other words, the two wings are curved away from each other. Center wing 25 lies opposite the free space between wing 17 and ribe 14 of the case and is curved downward (in FIG. 1), like lower wing 23.

To facilitate correct installation of case 4 (i.e., installation in the position shown in FIG. 1), base 6 extends beyond lower lateral wall 9*a* in the form of a reference tab 26 with a break-off line 27 in the immediate proximity of lateral wall 9*a* so as to be manually detachable if necessary, e.g., when two conduits must be juxtaposed, as will be explained below. This breakable tab may obviously be used for other purposes, e.g., as a gap guide, with the lower edge abutting the floor so as to ensure that the conduit will run parallel to it.

The height of tab 26 may be equal to H/3, H being the depth of the conduit, so that it will be hardly visible, if it is visible at all.

Covers of different types appropriate for various functions can of course be forseen, provided they are all equipped with the same snap-lock means that would allow them to be used interchangeably with the same type of case 4. For example, longitudinal ridge 22 might be eliminated, so that, with the exception of the slots, the front surface of the cover would be flat.

Covers without conductors or slots could also be forseen to serve as simple closing covers. Boxes 11 could then be used for loose wiring (e.g., telephone wire, patch cord for radio/television antenna, speaker wire, etc). Such an arrangement is shown in the upper portion of FIG. 1, in which conduit 3 comprises a case 4 (the same nunerical references are being used to designate elements identical to those in conduit 2) disposed as previously described, and a plain double cover 28 (one covering two boxes 11), provided with the same snap-lock means as cover 5.

Several conduits, such as conduits 2 and/or 3 described above, and/or still others such as the conduit of FIG. 2, which will be described below, may be stacked to form larger assemblies.

In this case, only the lower case retains lip 26. The lips of the cases to be stacked above are removed. By virtue of the approximately parallelopiped outer shape of each conduit, their juxtaposition may be made as perfect as possible, as shown in FIG. 1, and the whole may constitute an electrical power outlet of good appearance.

As shown in FIG. 1, for example, two conduits of two boxes each might be juxtaposed to form a four-box duct, with the one conduit supplying simple monophase electric current through a two-conductor cover, while the other is used as a twin channel under a blind cover.

Figure 2:
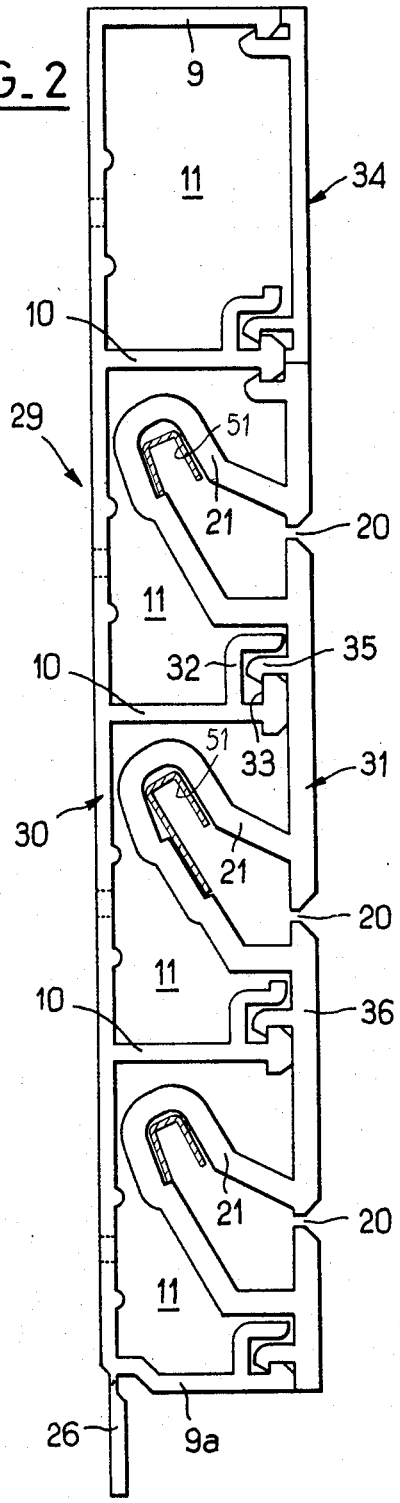
FIG. 2 is a schematic, large-scale, end view of another section of conduit conforming to the invention.

FIG. 2 shows another type of conduit 29 designed on the same principle as the ones in FIG. 1 but set up with four boxes. In other words, box 30 has three inner partitions 10 (the same numerical references are being used to designate elements identical to those in conduits 2 and/or 3) provided along their respective free edges with locking means designed to snap together with corresponding complementary means provided on the closing covers, e.g., on cover 31.

The two end partitions 10 are equipped with snap-lock means identical to those of partition 10 of conduits 2 and 3 of FIG. 1, while center partition 10 is equipped with snap-lock means identical to those with which the lateral walls are provided. It will be noted, however, that the leg of L-wing 32 is slightly longer than that of wings 16 of cases 4, while the opposite shoulder 33 is also longer so that this (single) partition may be able to fit together with the two abutting ends of two covers of two boxes, as is the case with the two joined partitions 9 of conduits 2 and 3 in FIG. 1.

Case 30 is closed using two covers 31 and 34.

Cover 34 is a single blind cover, i.e., it covers only one box and its upper longitudinal edge meets the extension of the outer surface of upper lateral wall 9 of the case, while its lower longitudinal edge stops essentially in the median plane of upper interior partition 10. The snap-lock means have already been described.

Cover 31 as a whole is arranged in accordance with the principles set forth for cover 2 of FIG. 1, with the difference that cover 31 is a triple cover, i.e., it covers three boxes 11 to form a three-conductor electrical outlet (three-phase, or monophase with ground, for example). The snap-lock means are formed in the same way, i.e., the wings are curved in the same direction (toward the bottom in FIG. 2), except for the upper wing, which is curved in the opposite direction (upwards in FIG. 2). In addition, wing 35 (the first numbered wing curved downward) is positioned so as to be able to snap together with shoulder 33, i.e., cover 31 can fit together equally well with a case having at least three boxes, such as case 30, or with two cases that have been juxtaposed so as to form at least three boxes, such as the two cases 4 of FIG. 1, with cover 31 spanning the two adjoining cases.

It will be noted that the lower longitudinal edge of cover 31 meets the extension of the outer surface of lower lateral wall 9*a* of case 30, while its upper edge coincides approximately with the median plane of upper interior partition 10, abutting the lower edge of cover 34.

It will also be noted that cover 31 comprises no safety ridge corresponding to ridge 22 of cover 5 in FIG. 1. Safety is ensurd by means of a different positioning of slots 20, which makes for different intervals between these slots. For this purpose, the two end slots (upper and lower) are located, like slots 20 of conduit 2 in FIG. 1, in the immediate vicinity of the upper junction of duct 21 with surface 36 of the cover, while the center slot lies in the immediate vicinity of the lower junction of duct 21 with surface 36.

The provisions of the invention thus make it possible to create electrical ducts perfectly suited to installation requirements by combining different case models with different cover models, all of which are built to fit together with snap-lock means.

Generally, it is possible to set up cases, and especially covers, in the following way.

Figure 3:
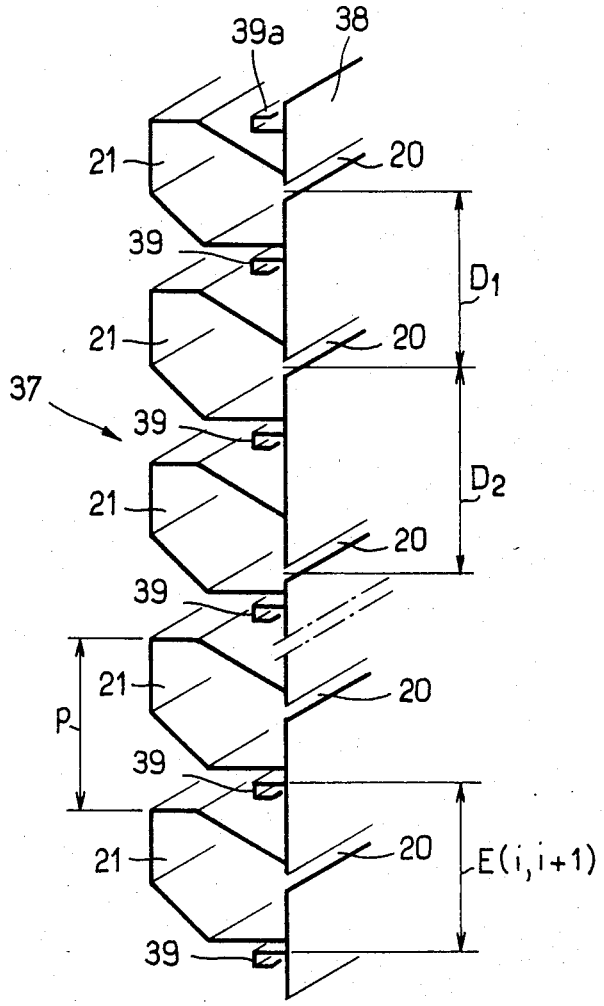
FIG. 3 is a very schematic, partial perspective of a conduit unit illustrating certain arrangements conforming to the invention.

FIG. 3 is a very simplified and schematic representation of a cover 37 equipped with n ducts 21 for n conductors (not shown) and having n access slots 20 to reach the n conductors in accordance with the arrangement explained above with reference to cover 5 in FIG. 1.

Surface 38 of cover 37 is further equipped with n+1 curved locking wings designed to snap together with n+1 complementary snap-lock means provided on the case (not shown). These wings are located between each duct 21. In addition, two wings are located beyond the end ducts.

A total of n of these wings 39 are curved in the same direction (downward in FIG. 3), while one (39*a*) of the end wings is curved in the opposite direction (upward in FIG. 3).

All of ducts 21 are equidistant from each other by an interval p.

The distance between two successive locking wings in positions i and i+1, measured from the upper wing, is:

$$E(i, i+1)=p+ke \text{ for even i}$$

$$E(i, i+1)=p-ke \text{ for odd i other than 1,}$$

and $$E(1, 2)=p-k_o e$$

with p=interval between ducts 21
e=thickness of surface 38 of cover
k=constant
$k_o$=another constant of value higher than k In general, it is possible to use:

$$k=\tfrac{1}{3} \text{ and } k_o=5/3.$$

In cases where the number of conductors is three or more, the spaces between two successive slots 20 alternate between the two different values $D_1$ and $D_2$, with $D_1+D_2=2p$.

In addition, it will be noted that for each box, the lateral walls that define it (lateral wall of the case and/or interior partition) have a single rib, for the upper wall (in the assembled position shown in FIGS. 1 and 2), and a rib and an L-shaped grip-reinforcing wing, for the lower wall.

Besides the particular geometric arrangement resulting from it, this arrangement combines advantageously with the aforementioned inclination of at least 20° of ducts 21 and with the fact that the deepest areas of these ducts are located, by virtue of this inclination, at or slightly below the approximate level of the snap-lock wings that precede them (with conduits in assembled position), to prevent errors of placement in the installation of covers and cases.

If the cover is placed in front of the case in the correct position, the distance between the snap-lock means located on the lateral wall of the boxes is just enough to allow the corresponding ducts to be pushed into the corresponding boxes. On the other hand, if the cover is held in reverse position (upside down), with the snap-lock wings of the cover facing the snap-lock means of the case, the deepest portion of the duct (now inclined downward) will butt against the lower snap-lock means of the respective boxes (which will be relatively high due to the presence of the L-shaped reinforcement wings) and it will not be possible to install the cover on the case.

In addition, it is advantageous to provide the interior partitions 10 of the cases with snap-lock ribs on both of their surfaces in symmetrical fashion. It will then be possible to install any type of cover onto the case in any dseired combination.

In this context, one might provide that the blind covers, for which no particular orientation is required, should be equipped with symmetrical snap-lock means on their two longitudinal ends, so that they may be installed on the case in any direction.

The form of the invention naturally seems particularly attractive when the number of component parts is relatively small. In such cases, the invention still provides for all possible combinations with regard to the number of boxes it is possible to obtain. For example, it would appear useful to have available cases having two, three, and four boxes; corresponding conductor-carrying covers, and blind covers corresponding to one, two, or three boxes, which should make it possible to create all sorts of electrical ducts for monophase electrical outlets with or without ground; triphase with or without neutral and with or without ground; several parallel outlets; channels for loose wiring, etc.

For reasons of electrical safety, the cases and covers are constructed from a nonconducting material. The rigid plastics habitually used in the electrical field appear all the better suited since they can be made into the appropriate shape by extrusion through a die. a form of manufacture that is particularly advantageous given the linear structure of the cases and covers.

A combination of several of the provisions described above might further be provided in the interest of enlarging the field of application of the electric conduit of the invention and/or increasing the number of safety features.

Figure 4:
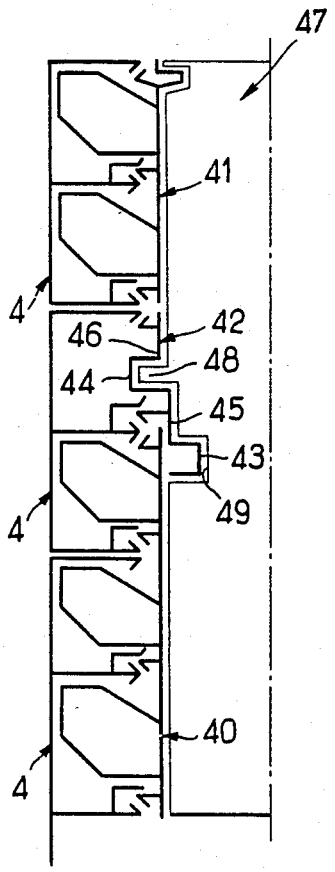
FIGS. 4 through 6 are highly schematized views illustrating a sample electrical outlet installation set up in accordance with the invention.
Figure 5:
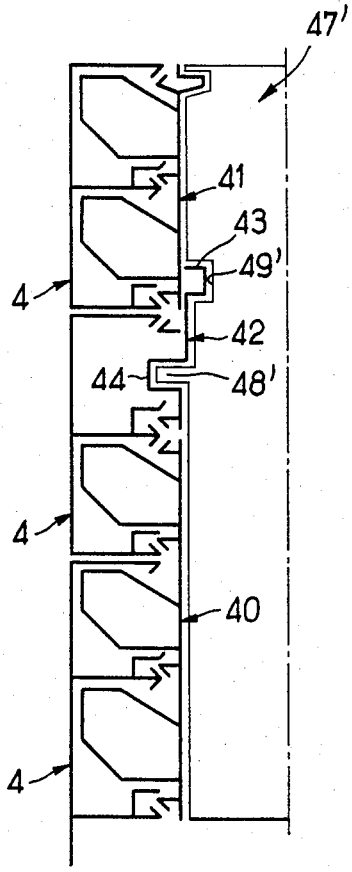
Figure 6:
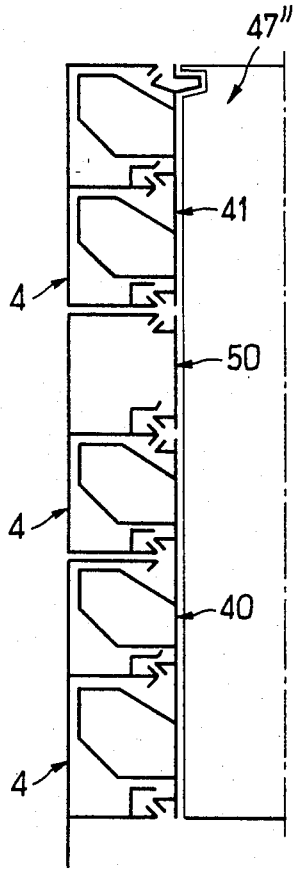

One example is illustrated in FIGS. 4 through 6 which, in very schematic fashion, show an electrical outlet installation consisting of a combination of three cases of two boxes each (the type designated as 4 in FIG. 1). In FIGS. 4 through 6, the covers are shown in front of, but not snapped into, the corresponding cases in order to make the drawings more easily readable.

In FIG. 4, a cover 40 equipped with three conductors (not shown) caps the lower case and the lower box of the middle case.

A cover 41 equipped with two conductors (not shown) caps the upper case.

The upper box of the middle case is topped with a special type of blind cover 42 comprising two longitudinal, parallel ridges, one (43) of which protrudes outward and the other (44) inward. Otherwise, this cover is set up in the same way as a flat cover like cover 3 of FIG. 1, particularly with regard to its snap-locking means.

It will be noted that cover 42 is wider than an ordinary flat cover and overlaps adjoining cover 40. For this reason, outer ridge 43 is located on a longitudinal part 45 of the cover that lies on a different level (offset outward) with respect to the longitudinal part 46 of the cover on which interior ridge 44 lies.

The electrical outlet thus formed is therefore a five-conductor outlet (e.g., triphase, with neutral and ground) that is very easy to implement using standard cases and covers similar to those that might be used for a monophase outlet having two-conductors (two phase) or three-conductors (two phase plus ground).

The presence of special cover 42 (safety cover) prevents any connection with this outlet except by a connector 47 (schematized in broken lines) having a precisely complementary profile, i.e., with a longitudinal ridge 48 and hollow (49) that in shape and placement will fit within the inner 44 and outer 43 ridges of cover 42.

In FIG. 5 (on which elements identical to those of FIG. 4 are designated by the same numerical references), the arrangement is similar to that of FIG. 4, with the difference that safety cover 42 is here mounted in reverse, i.e., with outer ridge 43 covering the adjoining cover 41 of the upper case. This possibility derives from the fact that, like flat blind covers, safety cover 42 is provided with symmetrical snap-locking means that allow it to be installed equally well in one direction or the other.

However, in the position of its ridge 48' and hollow 49', connector 47' must conform to this new shape.

With regard to the outlet of FIG. 6, blind cover 50 is a flat, ordinary cover like cover 3 of FIG. 1. As a result, connector 47'' should not have any protrusion, unlike connectors 47 and 47'.

It will be observed that it is thus easily and inexpensively possible to produce safety means that will permit only appropriate connectors to be connected to a given outlet.

Of coruse, the safety cover may have any other appropriate configuration and may be different from cover 42 shown in FIGS. 4 and 5. For example, it may extend over several boxes, may have only one ridge (inner or outer), or may have three or more, etc.

As is self-evident and as follows from the foregoing, the invention is in no way limited to the sample embodiments and applications specifically contemplated here. Rather, it encompasses all variants thereof.

We claim:

1. Continuous - accessibility electrical conduit designed to contain at least two electrical conductors and to have the appearance of a plinth or molding, when mounted on a wall or similar structural surface, comprising:

a base means in the form of a case (4; 30) having a back wall (6) and two lateral walls (9, 9*a*), each joined at a first end to said back wall and having a second end free, and defining a substantially U-shaped cross-section with an open portion, said base means being adapted to be fastened onto a structural surface, the case further comprising longitudinal interior partition means (10) having a first end attached to the back wall and having a second end free, said interior partition means delimiting individual compartments (11);

cover means (5; 31; 37) adapted to be mounted to said base means and to close said open portion of the case, said cover means comprising a non-conducting material having a front surface and in a first cover configuration at least two narrow, parallel longitudinal access means (21), each access means having a slot (20), each access means being adapted to contain an electrical conductor and each access means being adapted to fit into a respective one of said individual compartments; and snap lock means (12, 23, 24; 14, 25; 39, 39*a*) provided on the longitudinal free end of said interior partition means, and provided longitudinally on the cover means in a location opposite to said longitudinal free ends of said lateral walls and interior partitions means of the case, when said cover means is mounted on said base means;

and further characterized in that adjoining snap lock means are separated by a distance which alternatively is less than or greater than a constant value;

whereby, when said cover means is mounted on said base means with said snap lock means, each electrical conductor is enclosed in a non-conductive compartment and is electrically insulated from each adjoining electrical conductor and each compartment is substantially rigid and mechanically closed over the entire length of the two longitudinal free ends of said lateral walls and said interior partition means defining said compartments.

2. Electrical conduit of claim 1 wherein said adjoining snap lock means n and n+1 are separated by a distance E substantially defined as follows:

$$E(n, n+1)=p+ke \text{ (where n is an even integer)}$$

$$E(n, n+1)=P-ke \text{ (where n is an odd integer}\neq 1)$$

$$E(n, n+1)=p-k_o e \text{ (where n=1)}$$

with p=constant interval between electrical conductors
e=thickness of the cover means
k=constant
$k_o$=constant greater than k
n=order number of an electrical conductor counting from the end of the cover means contacting a first lateral wall of the case.

3. Electrical conduit of claim 2, characterized in that constants k and $k_o$ have the values of: $k=\frac{1}{3}$ and $k_o=5/3$.

4. Electrical conduit of claim 1 characterized in that said snap-lock means comprises wing means (23, 24, 25; 39, 39*a*) on said cover means and protruding rib means (12, 14) with a beak-shaped cross-section that form shoulders (13, 15) extending respectively along the free edges of the lateral walls (9, 9*a*) and interior partitions means (10) of the case and said wing means and said rib means being adapted to have a locking relationship and further characterized in that all of the wing means (23, 25; 39) face in the same direction, with the exception of one (24; 39*a*) that faces in the opposite direction.

5. Electrical conduit of claim 4 characterized in that the wing means (24; 39*a*) turned in the opposite direction from the others is adapted to lock with a rib means located along an edge of a lateral wall or an interior partition means.

6. Electrical conduit of any one of claims 1, 2, 3, 4 or 5, characterized in that the cover means is substantially equal in width to the outer width of the case and that several cases with their cover means are adpated to being juxtaposed.

7. Electrical conduit of any one of claims 1, 2, 3, 4 or 5, characterized in that shoulders are provided on both sides of the interior partition means and in that at least two cover means are adapted to being snapped side-by-side onto the same case.

8. Electrical conduit of any one of claims 1, 2, 3, 4 or 5, characterized in that cover means in a second cover configuration (28) without an access means is adapted to cover at least one compartment and form at least one empty compartment.

9. Electrical conduit of any one of claims 1, 2, 3, 4 or 5 wherein a plane containing the median axis of an access means (21) forms an angle of at least 20° to approximately 45° with a plane normal to the regular plane of the cover means.

10. Electrical conduit of any one of claims 1, 2, 3, 4 or 5, in which a conductor is positioned and held in place within an access means (21), said access means being formed of a single piece with the cover means and opening onto the corresponding access slot (20), characterized in that a plane containing the median axis of the access means is inclined away from a plane normal to the plane of the cover means by at least 20° to approximately 45° and in that the outer contour of each access means and the inner contour of the corresponding compartment are arranged such that the access means can enter the corresponding compartment of the case, and thereby enable the cover means to be installed onto the case in only one of the two possible positions in which the cover means can be positioned over the case.

11. Electrical conduit of claim 10, characterized in that all of the lateral walls and interior partition means of the case that have snap-lock means with wing means (23, 25; 39) turned in one direction are backed up, on the side of the corresponding rib means (12, 14), by a grip-reinforcement wing (16, 17) that lies opposite and apart from the rib means (12, 14), with said grip-reinforcement wing also constituting a safety stop that prevents an access means from entering the corresponding compartment when the cover means is not presented opposite the case in said one position.

12. Electrical conduit of any one of claims 1, 2, 3, 4 or 5, characterized in that each case comprises a longitudinal tab (26) attached to and disposed coplanar with the back wall of the case and being adapted to identify a direction of installation of the case, with the tab being manually removable in order to allow side-by-side juxtaposition of more than one case with their respective base means on a common structural surface.

13. Electrical conduit of claim 12, characterized in that the height of the tab is between H/3 and H, with H being the depth of the case.

14. Electrical conduit of any one of claims 1, 2, 3, 4 or 5, wherein the number of access means (21) is three or more and the distances separating consecutive access slots (20) alternatively have two sets values $D_1$ and $D_2$, with $D_1$ not equal to $D_2$, and such that $D_1+D_2=2_p$, with p being the interval between the access means.

15. Electrical conduit of any one of claims 1, 2, 3, 4 or 5, characterized in that said cover means comprises a longitudinal deformation (22), either male or female in shape, located closer to one of the longitudinal edges of the cover than to the other and designed to fit together with a deformation of a complementary shape, female or male, respectively, on a removable connector or plug designed to fit into said base means.

16. Electrical conduit of any one of claims 1, 2, 3, 4 or 5, wherein said cover means comprises a third configuration (42) for safety purposes sized to cover at least one compartment of a case and having at least two longitudinal, parallel deformations (43, 44) that protrude from the two surfaces of said cover means.

17. Electrical conduit of claim 16, characterized in that said cover means of a third configuration (42) is wider than a corresponding cover means of a first or second configuration and in that it is shaped in such a way that the part having a deformation (43) on the outside partially covers, when mounted, the cover means of a first or second configuration (40 or 41) of the adjoining compartment.

18. Electrical conduit according to claim 17, wherein the cover means of a third configuration (42) is provided with snap-lock means enabling it to be positioned on the case in both of the two possible directions of mounting.

* * * * *